US011185150B2

(12) United States Patent
Lin

(10) Patent No.: US 11,185,150 B2
(45) Date of Patent: Nov. 30, 2021

(54) MAKEUP BRUSH AND MANUFACTURING METHOD THEREOF

(71) Applicant: BEAUTY YAURIENT COSMETICS ACCESSORIES(SHENZHEN) CO.,LTD., Guangdong (CN)

(72) Inventor: Yuju Lin, Guangdong (CN)

(73) Assignee: BEAUTY YAURIENT COSMETICS ACCESSORIES (SHENZHEN) CO, Shenzhen (CN)

( * ) Notice: Subject to any disclaimer, the term of this patent is extended or adjusted under 35 U.S.C. 154(b) by 134 days.

(21) Appl. No.: 16/582,511

(22) Filed: Sep. 25, 2019

(65) Prior Publication Data

US 2021/0052060 A1 Feb. 25, 2021

(30) Foreign Application Priority Data

Aug. 19, 2019 (CN) ..... 201910764838.0

(51) Int. Cl.

| | |
|---|---|
| ***A46B 3/02*** | (2006.01) |
| ***A46B 9/02*** | (2006.01) |
| ***A46D 1/08*** | (2006.01) |
| ***A46D 1/06*** | (2006.01) |
| ***A46D 3/04*** | (2006.01) |

(52) U.S. Cl.

CPC ..... *A46B 3/02* (2013.01); *A46B 9/021* (2013.01); *A46B 9/026* (2013.01); *A46D 1/06* (2013.01); *A46D 1/08* (2013.01); *A46D 3/045* (2013.01); *A46B 2200/1046* (2013.01)

(58) Field of Classification Search

CPC ..... A46B 3/02; A46B 9/021; A46B 9/026; A46B 2200/1046; A46D 1/08

USPC ..... 15/168

See application file for complete search history.

(56) References Cited

U.S. PATENT DOCUMENTS

| | | | | | |
|---|---|---|---|---|---|
| 634,570 | A * | 10/1899 | Briggs | A46B 9/08 | 15/168 |
| 700,263 | A * | 5/1902 | Traub | A46B 9/08 | 15/168 |
| 2002/0046436 | A1* | 4/2002 | Suzuki | A46B 3/16 | 15/195 |
| 2012/0298130 | A1* | 11/2012 | Telwar | A46D 1/00 | 132/317 |
| 2018/0168325 | A1 | 6/2018 | Nicoline | | |

FOREIGN PATENT DOCUMENTS

| | | |
|---|---|---|
| CN | 1176623 C | 11/2004 |

* cited by examiner

*Primary Examiner* — Randall E Chin

(57) ABSTRACT

Disclosed are a makeup brush and a manufacturing method thereof. The makeup brush includes a brush head and a brush handle. A bristle sheet is tightly bonded to an outer root of the brush head, and a height of the bristle sheet is less than that of the edge of the brush head. Therefore, in the process of makeup, the layering of bristles of the brush head and the outer bristle sheet is enhanced to make the brush more stylish, contributing to a more delicate makeup effect and an increased skin touching feeling.

5 Claims, 4 Drawing Sheets

MAKEUP BRUSH AND MANUFACTURING METHOD THEREOF

CROSS-REFERENCE TO RELATED APPLICATIONS

This application claims the benefit of priority from Chinese Patent Application No. CN 201910764838.0 filed on Aug. 19, 2019. The content of the aforementioned application, including any intervening amendments thereto, is incorporated herein by reference in its entirety.

TECHNICAL FIELD

This application relates to beauty tools, particularly to a makeup brush and a manufacturing method thereof.

BACKGROUND OF THE INVENTION

There are various kinds of makeup brushes, which can be combined for a daily makeup according to personal habits. However, it is essential for a basic set to include six brushes, which are the loose powder brush, concealer brush, blush brush, eye shadow brush, eyebrow brush and lip brush.

The brush head of a professional makeup brush has various sizes and shapes corresponding to different parts where makeup will be applied. For example, the shape of the brush head can be an arc, a spired bevel or a plain top. Whether the lines and arcs of the brush head are smooth will affect the makeup effect.

Usually, for the commercially available makeup brush, the bristle length is selected according to the functions, and the bristle bundle is directly molded via a corresponding mold before the bristles are inserted into a tube. Consequently, the makeup brush is made of single bristle material, leading to a limited makeup effect, which can't satisfy the consumer requirements well.

SUMMARY OF THE INVENTION

To solve the problems of the unitary bristle material and the limited makeup effect of the existing makeup brush, the invention provides the following technical solutions.

An object of the invention is to provide a makeup brush, including a brush head and a brush handle. A bristle sheet is tightly bonded to an outer root of the brush head, and a height of the bristle sheet is less than that of an edge of the brush head.

In some embodiments, the bristle sheet has a hardness greater than that of a bristle of the brush head.

In some embodiments, the bristle sheet partially or completely wraps the outer root of the brush head.

In some embodiments, the bristle sheet has a hardness smaller than or equal to that of the bristle of the brush head.

In some embodiments, the bristle sheet includes at least two layers; a first bristle sheet layer abuts against the brush head, which has a hardness greater than that of a bristle of the brush head; a second bristle sheet layer is provided on the outer side of the first layer of the bristle sheet and has a hardness smaller than or equal to that of the bristle of the brush head; and a height of the second bristle sheet layer is greater than that of the first bristle sheet layer.

In some embodiments, the first bristle sheet layer, the second bristle sheet layer and the bristle of the brush head are the same or different in color.

Another object of the invention is to provide a manufacturing method of a makeup brush, which includes a brush head and a brush handle, including:

bundling and trimming a main bristle head for manufacturing the brush head;

cutting a bristle material for wrapping into a bristle sheet according to a shape of the brush head to allow a height of the bristle sheet to be less than that of an edge of the brush head;

tightly bonding and fixing the bristle sheet to an outer root of the main bristle head to form a makeup brush.

In some embodiments, before the step of cutting, the bristle material is glued according to the shape of the brush head.

In some embodiments, the step of tightly bonding and fixing the bristle sheet to an outer root of the main bristle head includes:

tightly bonding the bristle sheet to the outer root of the main bristle head, bundling the bristle sheet with a bristle on an edge of the main bristle head, and ironing or dispensing glue via a tube.

In some embodiments, the bristle sheet includes at least two layers, and the manufacturing method further includes:

arranging the first bristle sheet layer abutting against the brush head, wherein a hardness of the first bristle sheet layer is greater than that of the bristle of the brush head;

providing the second bristle sheet layer on an outer side of the first bristle sheet layer, wherein a hardness of the second bristle sheet layer is smaller than that of the bristle of the brush head, and a height of the second bristle sheet layer greater than that of the first bristle sheet layer.

The embodiments of the invention provide a makeup brush and a manufacturing method thereof. The makeup brush includes a brush head and a brush handle. A bristle sheet is tightly bonded to the outer root of the brush head, and a height of the bristle sheet is less than that of an edge of the brush head. Therefore, in the process of makeup, the layering of the brush head, bristle and the outer bristle sheet is enhanced to make the brush more stylish, contributing to a more delicate makeup effect and an increased skin touching feeling.

BRIEF DESCRIPTION OF THE DRAWINGS

The technical solutions of the prior art or the invention will be described with reference to the drawings according to the embodiments for a better understanding. Obviously, various variations and modifications of the invention can be made by those skilled in the art without departing from the spirit and scope of the invention.

Figure 1:
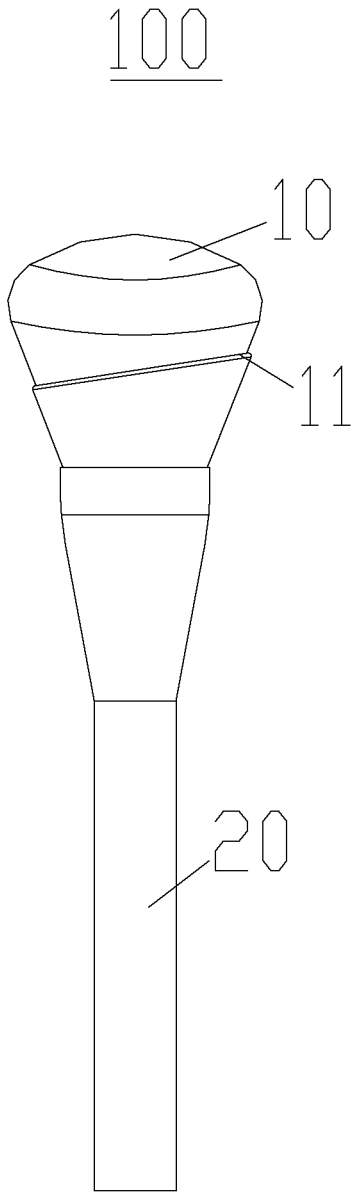
FIG. 1 is a front view showing a makeup brush according to an embodiment of the invention.

In the drawings: 100—makeup brush; 10—brush head; 20—brush handle; 11—bristle sheet; 12—first bristle sheet layer; 13—second bristle sheet layer.

DETAILED DESCRIPTION OF EMBODIMENTS

The technical solutions of the embodiments of the present invention will be clearly and completely described with reference to the accompanying drawings. However, the invention may be implemented in various modes and is not limited to the embodiments described herein. It should be noted that various variations and modifications of the invention made by those skilled in the art without departing from the spirit and scope of the invention should fall within the scope of the invention.

The directional terms, such as above, below, left, right, front, back, etc., in the description are used only for illustrating the relative position and the movement situation between the parts of the embodiments in a specific state shown in the drawings, so the directional terms may accordingly change as the state changes.

In addition, descriptions "first", "second", and the like in the invention are used for descriptive purposes only, and are not to be construed as indicating or implying relative importance thereof or implicitly indicating the number of the technical features. Therefore, features defined by "first" and "second" may explicitly or implicitly include at least one of the features. Moreover, the technical solutions of different embodiments can be combined by those skilled in the art if the combination can be realized. However, the combination of the technical solutions, which is contradictory or cannot be achieved, shall be excluded from the scope of the invention.

Unless otherwise defined, terms, such as "connection" and "fix", used herein has the same meaning as commonly understood. For example, the term "fix" used herein may represent an undetachable connection, a detachable connection, an integration, a mechanical connection, an electronic connection, a direct connection, an indirect connection via an intermediary, an internal connection or an interaction of two components. Those skilled in the art can understand the specific meanings of the above terms in the invention based on practical situations.

Example 1

Figure 2:
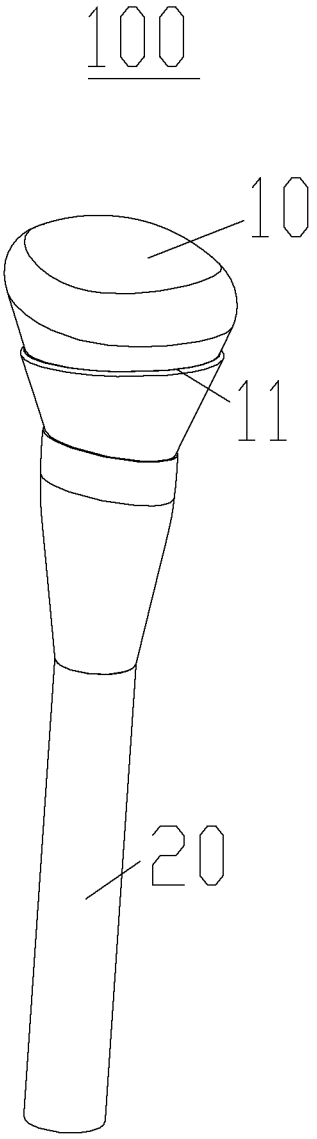
FIG. 2 is a perspective view showing the makeup brush according to an embodiment of the invention.
Figure 3:
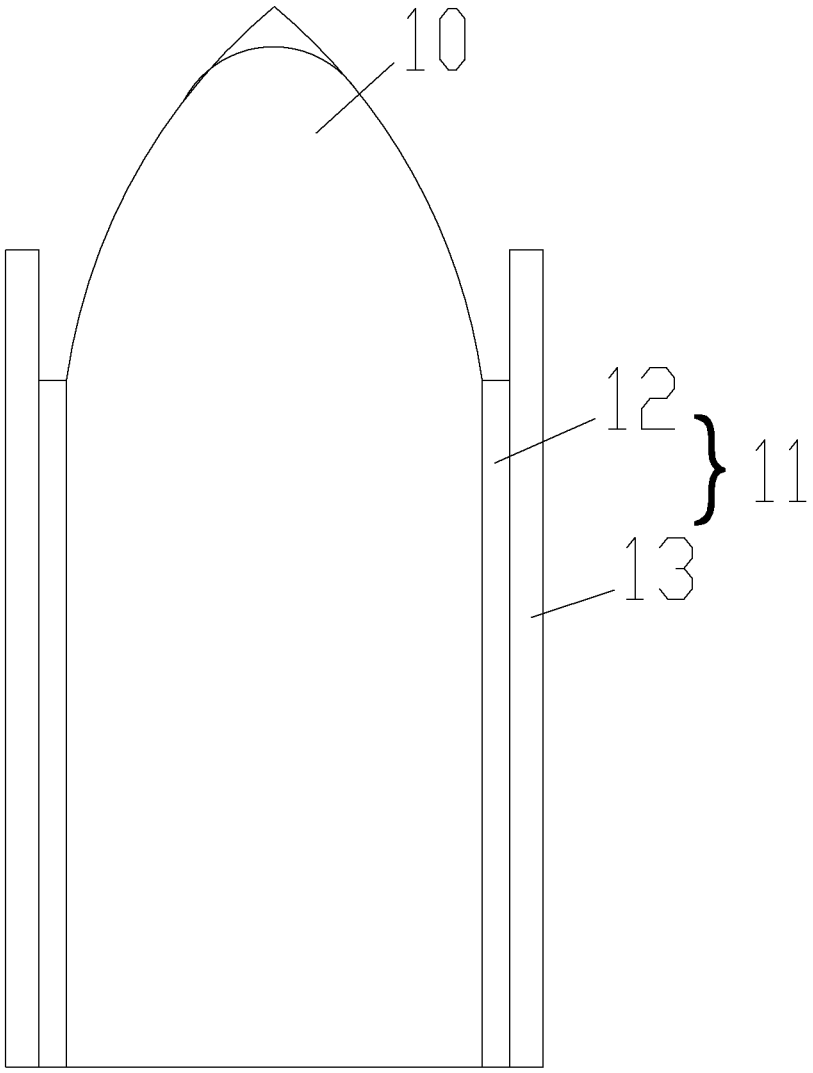
FIG. 3 is a schematic diagram showing a partial structure of the makeup brush according to an embodiment of the invention.

As shown in FIGS. 1-3, the invention provides a makeup brush 100, including a brush head 10 and a brush handle 20, in which a bristle sheet 11 is tightly bonded to an outer root of the brush head 10, and a height of the bristle sheet 11 is less than that of an edge of the brush head 10.

Specifically, the bristle sheet 11 is made by stacking multiple bristles together. A bristle sheet 11 made of different bristle materials, colors or shapes is bonded around the outer root of the brush head 10. Thus, the brush head 10 is wrapped with a whole or semi circle of the bristle sheet, that is, the bristle sheet 11 partially or completely wraps the outer root of the brush head, forming a stamen-shaped bristle head of the makeup brush 100, achieving an increased elasticity of the original bristle head, a better skin touching feeling, etc. The bristle head is a combination of the brush head 10 and the bristle sheet 11 after the bristle sheet 11 is arranged at the outer root of the brush head 10.

Moreover, the bristle sheet 11 can be arranged at a position higher than the outer root of the brush head 10. Although the height of the bristle sheet 11 is less than that of the edge of the brush head 10, the bristle sheet 11 can reach half, one-third or two-thirds, or some other ratio values which are not limited here, of the height of the edge of the brush head 10. The addition of the bristle sheet 11 with different bristle materials and heights around the brush head 10, can realize various usage and makeup feelings when different directions are selected to operate the bristle head.

In this embodiment, the makeup brush can be used as the loose powder brush, concealer brush or blush brush.

It should be noted that, during the manufacturing process of the brush head 10, the toughness and the fixation in the brush handle 20 should be taken into consideration, and it is of great significance to consider the bristle material, height and quantity of the brush head 10, the fixation and settlement position between the end of a bristle of the brush head 10 and the brush handle 20. In this embodiment, a layer of bristle sheet 11 is added at the outer root of the bristle of the brush head 10, but the bristle sheet 11 may have a hardness greater than that of the bristle of the brush head 10 in some embodiments. Thus, the bristle sheet 11 forms a starched bristle material surrounded the bristle of the brush head 10, increasing the closeness of the bristle head of the brush, achieving an improved usage feeling and more even and delicate makeup.

In some embodiments, the bristle sheet 11 has a hardness smaller than or equal to that of the bristle of the brush head 10. With the soft bristle sheet 11 surrounded the brush head 10, the makeup brush provides an increased skin affinity of the makeup.

In some embodiments, as shown in FIG. 3, the bristle sheet 11 includes at least two layers, and the thickness of the two layers may have the same thickness. The first bristle sheet layer 12 abuts against the brush head 10, which has a hardness greater than that of the bristle of the brush head 10; the second bristle sheet layer 13 abuts against the outer side of the first bristle sheet layer 12, away from the brush head 10. The hardness of the second bristle sheet layer 13 is smaller than that of the bristle of the brush head 10, and the height of the second bristle sheet layer 13 is greater than that of the first bristle sheet layer 12. Therefore, the harder first bristle sheet layer 12 can provide an auxiliary support for the brush head 10. Meanwhile, the softer second bristle sheet layer 13 separates the first bristle sheet layer 12 from the customer's skin, providing a softer touch feeling. When the bristle sheet 11 with soft bristle material is added around the brush head 10, the makeup brush provides an enhanced skin affinity of the makeup.

In some embodiments, colors of the first bristle sheet layer 12, the second bristle sheet layer 13 and the bristle of the brush head 10 are same with or different from each other.

In this embodiment, a plurality of bristle sheets 11, arranged around the outer side of the bristle head 10, form a stamen shape, in which the bristle material of the bristle sheet 11 and the bristle head 10 can be the same or different class. They may have the same or different colors to represent different functions and different elasticity may shape different styles. In the process of makeup, the makeup brush 100 is more stylish in use of the bristle with different softness, elasticity and match, which enhances the detail makeup effect and allows the makeup to be more even and delicate.

In conclusion, a bristle sheet 11 with different bristle materials, colors or shapes is bonded around the outer root of the brush head 10. The bristle sheet 11 can be designed to the shape according to any desirable bristle head shape, such as a stamen shape of gardenia, plum or peach, or wavy shape, pentagram, normal flat shape or inclined shape. The required shape is formed by wrapping bristle sheet with the corresponding material, color and length at the outer root of the brush head 10.

Example 2

Figure 4:
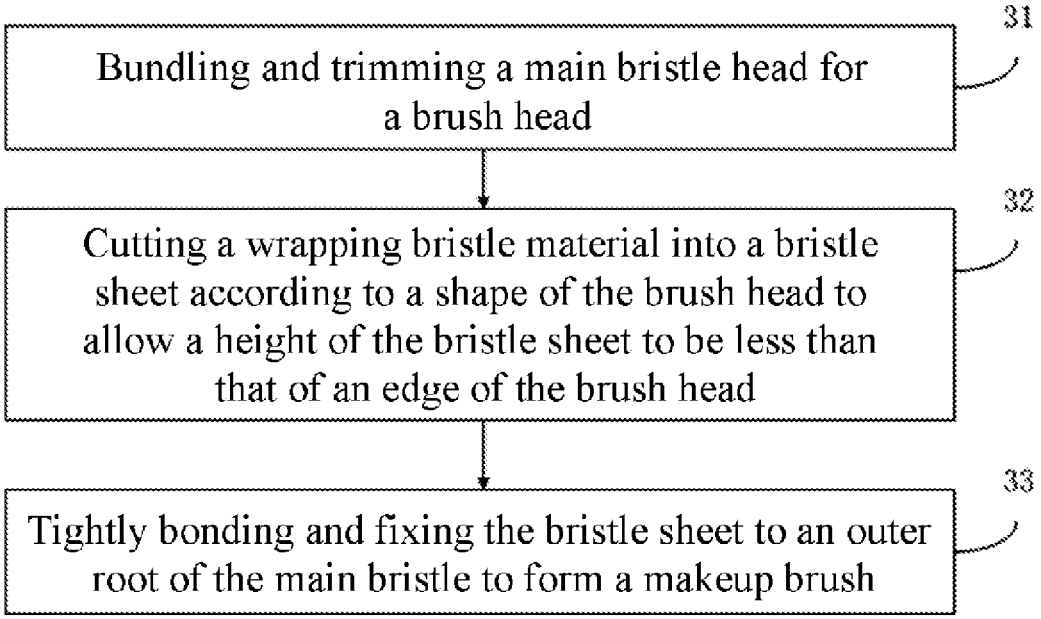
FIG. 4 is a flow chart showing a manufacturing method of the makeup brush according to an embodiment of the invention.

As shown in FIG. 4, this embodiment provides a manufacturing method of a makeup brush including a brush head and a brush handle, including the following steps.

Step 31: the main bristle head is bundled and trimmed for manufacturing the brush head.

In some embodiments, the bristles of brush head are combined with the brush handle of the makeup brush. The bristles are inserted into the joint component of the brush handle and the bristle head, so that the brush head of the makeup brush is supported by the joint component. The rear or root of the bristles of the brush head of the makeup brush is inserted into the joint component, and the joint component is supported by the brush handle.

In the manufacturing process, the brush head is bundled to fix the shape of bristles, and then the bundling rope is removed after the glue is dispensed, keeping the bristles of the brush head in a good shape.

Step 32: a wrapping bristle material is cut into a bristle sheet according to a shape of the brush head to allow a height of the bristle sheet to be less than that of an edge of the brush head.

Step 33: the bristle sheet is tightly bonded and fixed to an outer root of the main bristle head to form a makeup brush.

After the bristle shape is molded in step 31, the bristle shape is tied for a style. Then, a circle of bristle sheet with different or same bristle material, color or shape is bonded around the outer root of the brush head. Thus, the brush head is wrapped to form a stamen-shaped bristle head, increasing the elasticity of the original bristle head or the skin touching feeling of the makeup brush, etc.

In conclusion, the manufacturing method of the makeup brush in the invention includes the following steps. The main bristle head is bundled and trimmed for manufacturing the brush head, and then a bristle sheet is tightly bonded to the outer root of the brush head, and a height of the bristle sheet is less than that of an edge of the brush head. Therefore, in the process of makeup, the layering of bristles of the brush head and the outer bristle sheet is enhanced to make the brush more stylish, contributing to a more delicate makeup effect and an increased skin touching feeling.

It should be noted that the makeup brush in Example 1 and the manufacturing method of the makeup brush are based on the same inventive concept, so all characteristics of the makeup brush should be introduced into the manufacturing method of the makeup brush.

In some embodiments, the contact area of the joint component and the brush handle of the makeup brush is pressured, so that the joint component is combined with the brush handle of the makeup brush.

In some embodiments, the process of cutting the bristle material for wrapping into the bristle sheet according to a shape of the brush head includes the following steps.

the wrapping bristle material is glued according to the shape of the brush head. After dried, the wrapping bristle material is cut into the bristle sheet.

In some embodiments, the process of tightly bonding and fixing the bristle sheet to an outer root of the main bristle head includes the following steps.

The bristle sheet is tightly bounded to the outer root of the main bristle head, and the bristle sheet is bundled with a bristle on an edge of the main bristle head, and the bristle sheet and the bundled bristle are ironed or dispensed glue via a tube.

The tube for dispensing glue can be a metal casing.

In some embodiments, the bristle sheet includes at least two layers, and the method for arranging the bristle sheet further includes the following steps.

The first bristle sheet layer is arranged to abut against the brush head, where the first bristle sheet layer has a hardness greater than that of the bristle of the brush head.

The second bristle sheet layer is arranged to abut against the outer side of the first layer, away from the brush head, which has a hardness smaller than that of the bristle of the brush head, and a height greater than that of the first bristle sheet layer.

Therefore, the hard first bristle sheet layer can provide an auxiliary support for the brush head, and the soft second bristle sheet layer separates the first bristle sheet layer from the customer's skin, providing a softer touch feeling. When the bristle sheet with soft bristle material is added around the brush head, the makeup brush provides an enhanced skin affinity of the makeup.

The above is only some preferred embodiments of the invention, and is not intended to limit the scope of the invention. Variants and modifications may be made by those skilled in the art. Equivalent substitutions based on description and drawings of the present invention or direct or indirect applications in relative fields within the concept of the invention shall fall within the scope of the invention.

I claim:

1. A makeup brush, comprising a brush head and a brush handle;

wherein a bristle sheet is tightly bonded to an outer root of the brush head, and a height of the bristle sheet is less than that of an edge of the brush head; and the bristle sheet has a hardness greater than that of a bristle of the brush head.

2. The makeup brush of claim 1, wherein the bristle sheet partially or completely wraps the outer root of the brush head.

3. A makeup brush, comprising a brush head and a brush handle;

wherein a bristle sheet is tightly bonded to an outer root of the brush head, and a height of the bristle sheet is less than that of an edge of the brush head; and wherein the bristle sheet has a hardness smaller than or equal to that of a bristle of the brush head.

4. A makeup brush, comprising a brush head and a brush handle;

wherein a bristle sheet is tightly bonded to an outer root of the brush head, and a height of the bristle sheet is less than that of an edge of the brush head; and wherein the bristle sheet comprises at least two layers; a first bristle sheet layer abuts against the brush head and has a hardness greater than that of a bristle of the brush head; a second bristle sheet layer is provided on an outer side of the first bristle sheet layer and has a hardness smaller than or equal to that of the bristle of the brush head; and a height of the second bristle sheet layer is greater than that of the first bristle sheet layer.

5. The makeup brush of claim 4, wherein the first bristle sheet layer, the second bristle sheet layer and the bristle of the brush head are the same or different in color.

* * * * *